United States Patent [19]

Yuhara

[11] Patent Number: 4,595,028

[45] Date of Patent: Jun. 17, 1986

[54] VANITY CASE

[75] Inventor: Yukitomo Yuhara, Abiko, Japan

[73] Assignee: Yoshida Industry Co., Ltd., Tokyo, Japan

[21] Appl. No.: 483,842

[22] Filed: Apr. 8, 1983

[30] Foreign Application Priority Data

Dec. 24, 1982 [JP] Japan ..... 57-195165

[51] Int. Cl.[4] ..... A45D 40/00

[52] U.S. Cl. ..... 132/79 R; 132/83 R

[58] Field of Search ..... 132/83, 79

[56] References Cited

U.S. PATENT DOCUMENTS 4,474,196 10/1984 Yuhara ..... 132/83 R

*Primary Examiner*—Gregory E. McNeill

*Attorney, Agent, or Firm*—Wenderoth, Lind & Ponack

[57] ABSTRACT

A vanity case comprises a receptacle member, a cover member hinged with the receptacle member, and a slide element disposed in a recessed portion of the receptacle. The slide element has a tongue upwardly extending from the front end thereof and provided with an inclined outer surface which abuts the front end of the cover member. The slide element also has a rear extension extending into a recess formed at the rear end of the receptacle, and when the rear extension is pushed forwardly the inclined outer surface forces the cover member away from the receptacle member, thereby releasing engagement between a first and second latch means formed on the front end of respective members.

5 Claims, 5 Drawing Figures

VANITY CASE

BACKGROUND OF THE INVENTION

The present invention relates to improvement of a vanity case, and more particularly to improvement of a latch-unlatch mechanism for a vanity case in which a receptacle member is hinged with a cover member through a connection between the hinge block provided at the rear end of the cover member and the recess formed at the rear end of the receptacle member.

In the conventional vanity case of the type set forth above, the cover member is maintained in a closed position relative to the receptacle member by engagement between elastic latch tongues each formed on the front edge of each member. These latch tongues should have a very high accuracy in dimension for obtaining a smooth engagement and disengagement therebetween. Otherwise, the cover member would open accidentally or a relatively strong force has to be exerted to open the cover, thereby causing trouble to a user. Therefore, when molding the vanity case, the utmost attention has been paid to the accuracy of the latch tongues. Nevertheless, quite a number of vanity cases have been rejected as defective owing to inferior engagement, and a low yield is one of the greatest problems in the production.

In the circumstances, improved vanity cases have been proposed which are disclosed, for example, in the U.S. Pat. Nos. 4,276,893 and 4,331,168. Such a vanity case is provided with a slide member in the vicinity of the latch tongue of either the case body or the cover member and, by pressing the slide member, the cover is so forced as to separate from the case body whereby the engagement between both latch tongues can be released. With this construction, some dimensional error can be allowed. However, this improvement is not free from defects, either. One of the defects is that since the slide member is designed to be inserted into a cavity slenderly extending in the longitudinal direction, vibration is likely to occur during a long period of use. Another defect is that since the latch tongues and slide member are arranged on the place which is externally accessible and therefore most exposed to the eyes, designer encounters difficulties in representing various decorative designs on the vanity case.

Therefore, an object of the present invention is to provide a vanity case which is so simple in operation as to enable the user to open the cover member by one touch operation and which permits dimensional error of the latch tongues.

Another object of the present invention is a provision of a vanity case in which vibration noise will not occur thereby maintaining a high-grade image thereof.

A further object of the present invention is to provide a vanity case which permits variety of design thereof without spoiling operability of the case.

A still further object of the present invention is to provide a vanity case which can be manufactured and assembled easily.

SUMMARY OF THE INVENTION

A vanity case according to the present invention comprises a receptacle member having a recessed portion therein for containing cosmetic material, a cover member to be hinged with the receptacle member, and a slide element disposed in the recessed portion of the receptacle member. The receptacle member is formed at the rear end with a recess into which hinge block provided at the rear end of the cover member is fitted for pivotable connection. Provided on the front inner surface of the receptacle member defining the concaved portion is a first latch means which is engaged with a second latch means formed on the lower surface of the cover member to maintain the cover member in a closed position relative to the receptacle member. The slide element has a tongue which extends upwardly from the front end of the slide element and which is provided with an inclined outer surface, the inclined outer surface abutting the front end of the cover member when the latter is in the closed position. The slide element also has a rear extension extending into the recess of the receptacle member without contacting the hinge block of the cover member. When the rear extension is pushed forwardly, the inclined outer surface forces the cover member away from the receptacle member and releases engagement between the first and second latch means, thereby moving the cover member to an open position.

Preferably, the cover member includes a projection downwardly extending from the lower surface of the front end thereof, the second latch means being formed on the projection, and the inclined outer surface of the slide element is in contact with the lower end of the projection.

Further objects and features of the present invention will become apparent from the detailed description of preferred embodiments thereof when taken in conjunction with the accompanying drawings, in which:

DETAILED DESCRIPTION OF THE INVENTION

Figure 1:
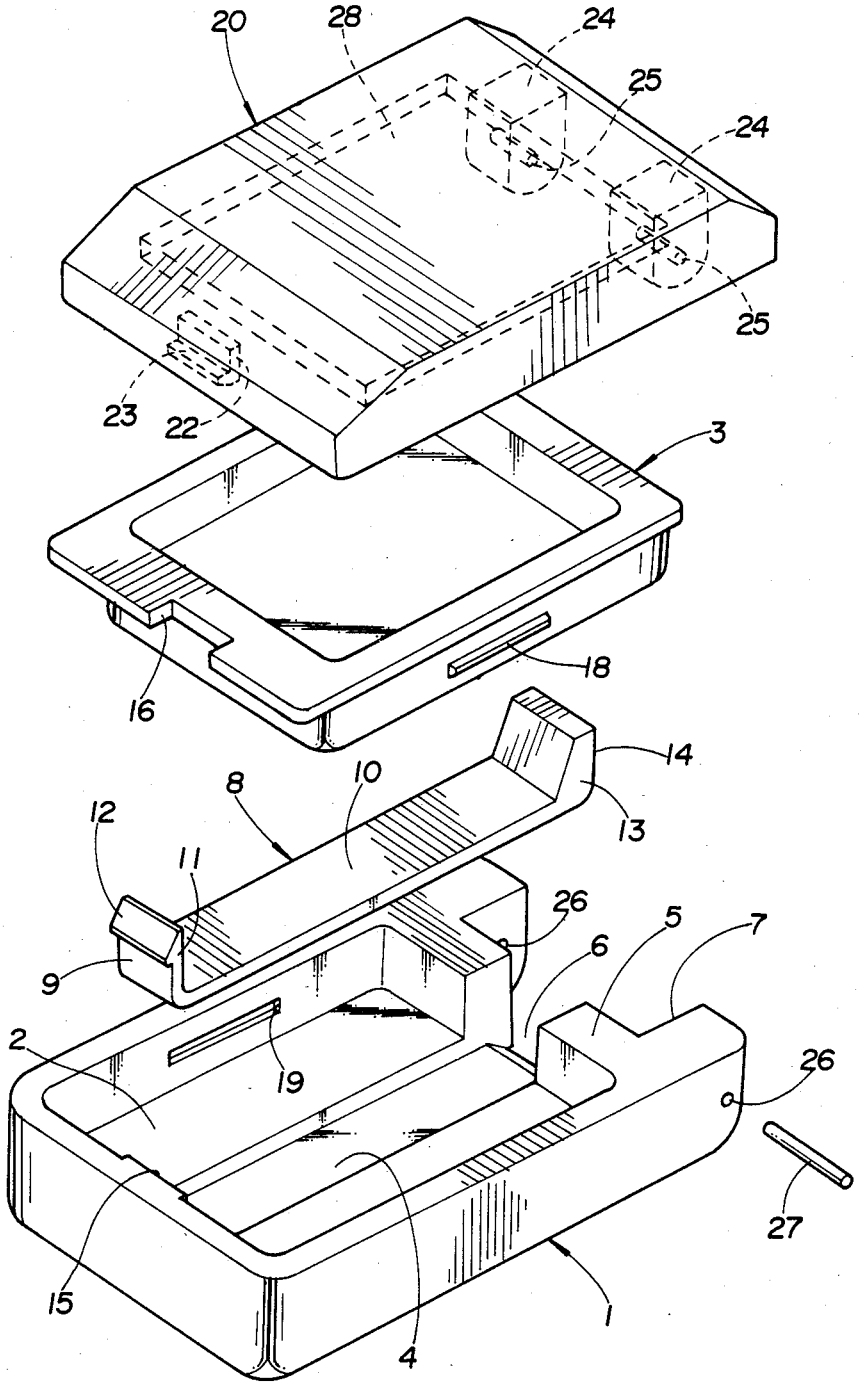
FIG. 1 is an exploded perspective view of a vanity case according to a first embodiment of the present invention, showing each part before assembly.
Figure 2:
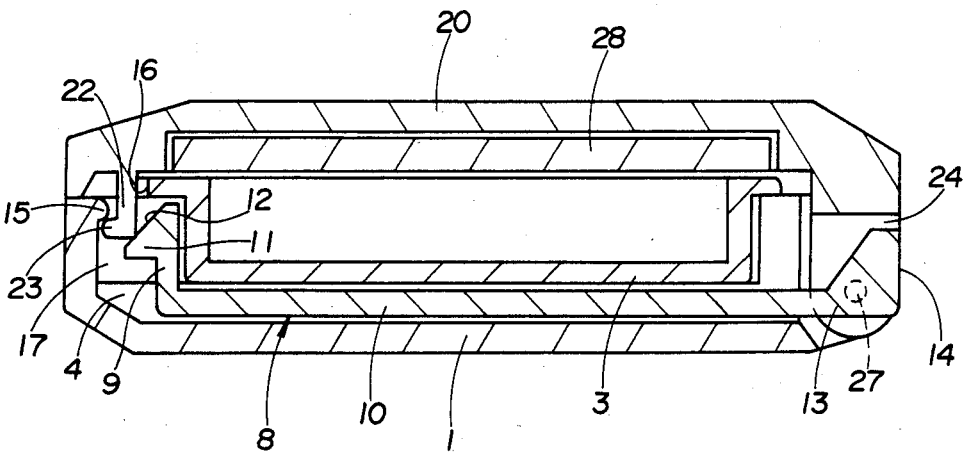
FIG. 2 is a sectional view of the vanity case shown in FIG. 1 in a closed position of a cover member after assembly.
Figure 3:
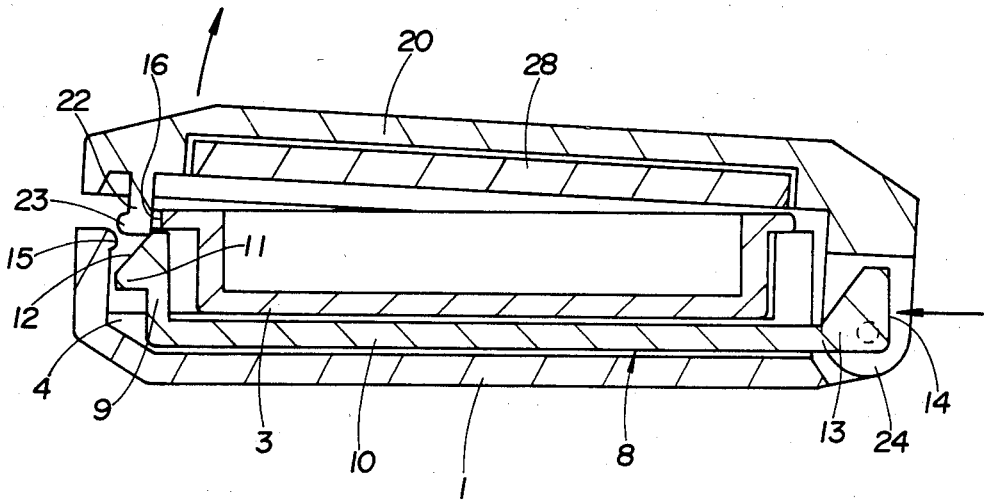
FIG. 3 is a similar sectional view of the vanity case, where a slide element is pressed and the cover member is partly opened.

Referring to FIGS. 1 to 3, there is shown a vanity case according to a first embodiment of the present invention. Reference numeral 1 indicates a receptacle member which has a concaved portion 2 therein to receive a cosmetic containing tray 3. Provided in the bottom surface defining the portion 2 is a guide groove 4 which extends longitudinally from a front inner surface of the receptacle 1 to a rear end wall 5 defining the portion 2 and communicates, through a cut 6 formed in the rear wall 5, with a rectangular recess 7 which is provided at the rear end of the receptacle 1.

The groove 4 is intended to guide a longitudinal movement of a slide element 8 which is slidably fitted in the groove 4. The slide element 8 has at its front end a tongue 9 extending upwardly from a base plate 10 of the slide element 8. Provided on the outer surface of the top end of the tongue 9 is a hook portion 11, which has a slanted outer surface 12 inclined to the direction of movement of the slide element 8, to be cooperated with a projection 22 as hereinafter described. Upon fitting the slide element 8 into the guide groove 4, the hook portion 11 is located away from the front inner surface of the receptacle 1 at a distance where the projection 22 may be entered.

The slide element 8 also has at the rear end thereof an extension 13 extending through the cut 6 into the recess 7 where the extension 13 is enlarged to form a vertical end surface 14. This end surface 14 is, after assembly of the vanity case, accessible from the outside of the case so that the user may slide the slide element 8 by pressing the end surface 14 with her finger.

The receptacle member 1 is provided on the upper end of the front inner surface thereof with a first latch 15 which is engageable by snap action with a second latch 23 formed on the lower end of the projection 22. At a position corresponding to these latches 15 and 23 and the projection 22, the peripheral flange of the cosmetic containing tray 3 is cut out to form a small recess 16 thereby permitting an entrance of the projection 22 into a hollow space 17 that is generally defined by the front inner surface of the receptacle 1 and the front wall of the tray 3. The tray 3 may be fixed to the receptacle member 1 by any suitable means and preferably by lateral protrusions 18 formed on the side walls of the tray 3 and corresponding lateral grooves 19 in the receptacle 1. Although the drawing shows only one protrusion 18 and one groove 19, it will be understood that a pair of such protrusions and grooves are provided on opposite sides.

A cover member 20 is coupled with the receptacle member 1 so as to open and close relative to the latter. Particularly, the cover member 20 is provided on the lower surface of its rear end with a pair of hinge blocks 24—24 extending downwardly which are inserted in the recess 7 of the receptacle 1. After pin holes 25—25 in the hinge blocks 24—24 are aligned with eyelets 26—26 in the receptacle 1, pivot pins 27—27 are pushed into those holes and eyelets to pivotably connect the cover 20 to the receptacle 1. The pair of hinge blocks 24—24 are disposed apart from each other thereby providing a space therebetween, where the extension 13 of the slide element 8 is located. Such arrangement permits a rotational movement of the hinge blocks 24 without being prevented by the extension 13, when the cover member 20 is opened or closed relative to the receptacle 1.

Attached on the lower surface of the cover member 20 is a mirror 28 for convenience of the user. The projection 22 is provided at the front end of the cover 20 and extends downwardly from the lower surface thereof.

FIG. 2 shows a closed position of the cover in a member 20 relative to the receptacle 1, where the first latch 15 is engaged with the second latch 23 to secure the cover closed position. The inner lower end of the projection 22 is in contact with the inclined surface 12 of the slide element 8 which is in turn retained in its rearmost position. In this state, when the vertical end surface 14 is pushed forwardly by the finger of the user, the slide element 8 slides forwardly along the guide groove 4 to move the tongue 9 as well as the hook portion 11 in the same direction. This movement of the hook portion 11 imparts to the projection 22 such a force as to lift the latter upwardly while sliding the projection 22 on the inclined surface 12, whereby the engagement between the first and the second latches 15 and 23 is released as shown in FIG. 3. At the same time, the cover member 20 is partly opened so that the user may open the cover 20 at a desired angle for using cosmetic material and the mirror 28.

Once the cover member 20 is partly opened, it will not be closed upon the receptacle 1 without pressing the cover downwardly. Assuming that the cover member 20 is opened and the slide element 8 is in the position shown in FIG. 3, when the cover member is pressed downwardly, the second latch 23 will be engaged with the first latch 15 while the projection 22 slides the slide element 8 backwardly.

As it could be understood from the description above, the cover member 20 can be opened quite easily by pressing the slide element 8 forwardly. The latches 15 and 23 for holding the cover 20 in the closed position are provided inside the vanity case and therefore are not externally visible. The slide element 8 is also disposed inside the vanity case, and the only part that is externally accessible is the vertical end surface 14 located at the rear end which is apparently less exposed to the eyes than the front end and/or the side portion. This structure will permit variety of the decorative design of the vanity case.

Figure 4:
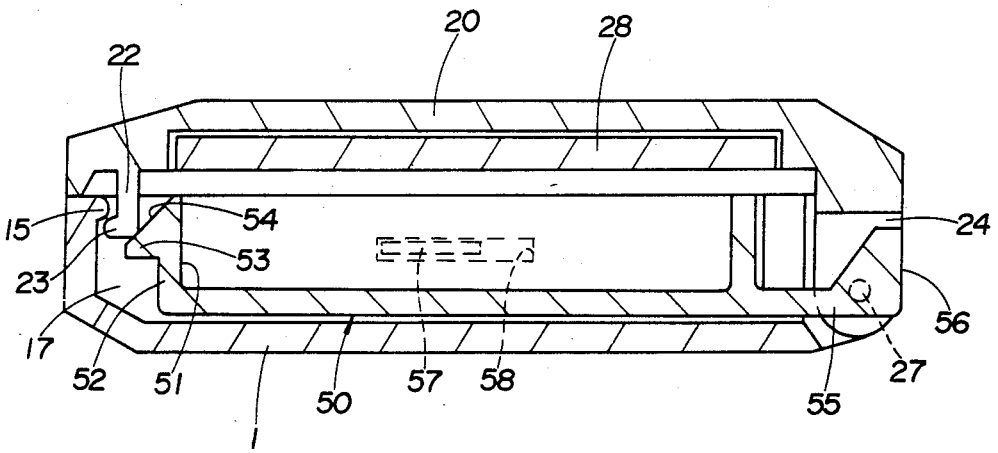
FIG. 4 is a sectional view showing a vanity case according to a second embodiment of the present invention.
Figure 5:
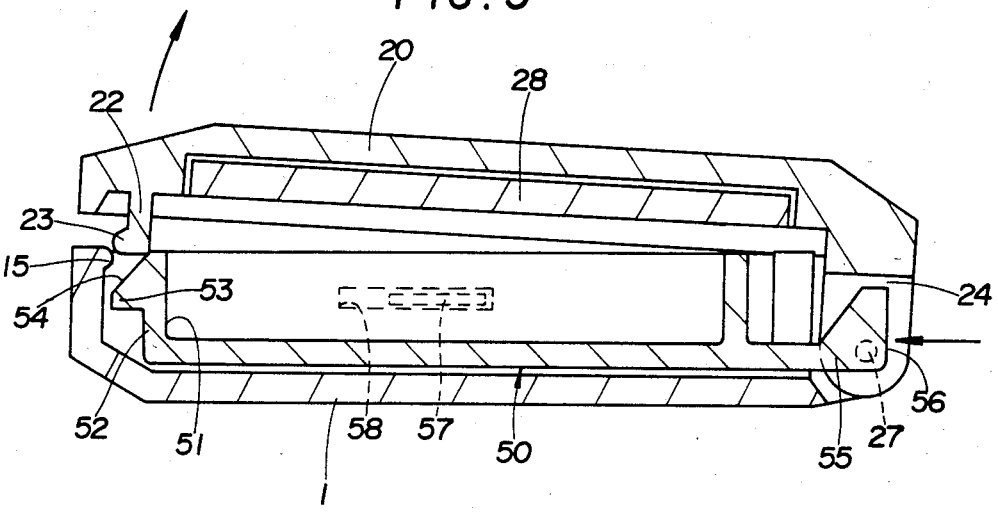
FIG. 5 is a sectional view of the same vanity case but in a position similar to FIG. 3.

Reference is now made to a second embodiment of the present invention, a vanity case according thereto being shown in FIGS. 4 and 5 in which the same or corresponding parts are indicated by the same reference numeral as in the first embodiment. In this vanity case, a slide element generally indicated by a numeral 50 has a cosmetic containing tray 51 as an integral part. A front wall of the tray 51 provides a tongue 52 which is provided on the outer surface of the top end with a hook portion 53 having an inclined outer surface 54. The rear end of the slide element 50 is extended beyond the rear wall of the tray 51 to form an extension 55 and an enlarged portion which is located in the recess 7 of the receptacle member 1 for convenience of pressing the slide element 50 at a vertical end surface 56.

The tray 51 is provided on both side walls with lateral protrusions 57 and the receptacle 1 has a pair of grooves 58 to receive the protrusions 57, thereby securing the tray 51 in the recessed portion 2 of the receptacle 1. The grooves 58 are formed longer than the protrusions 57 so that the protrusions 57 may be slidable relative to the grooves 58. Thus, when the end surface 56 of the slide element 50 is pressed forwardly, the tray 51 moves in the same direction with the element 50, whereby the inclined surface 54 pushes up the projection 22 to release the engagement between the first latch 15 and the second latch 23 and to partly open the cover member 20 as in the case of the first embodiment. It will be seen that the grooves 58 guide the sliding movement of the tray 51, which permits an omission of the guide groove 4 provided in the first embodiment.

Although the present invention has been described with reference to the preferred embodiments thereof, many modifications and alterations may be made within the spirit of the present invention.

What is claimed is:

1. A vanity case comprising:

a receptacle member having a recessed portion therein for containing cosmetic material and having a recess at a rear end thereof;

a cover member having a hinge block at a rear end thereof;

said receptacle member and said cover member being hinged together by fitting said hinge block into said recess;

a first latch means provided on the front inner surface of said receptacle member defining said recessed portion thereof;

a second latch means provided on the front lower surface of said cover member;

said first and second latch means being engaged with each other by snap action when said receptacle member is closed by said cover member, thereby maintaining said cover member in a closed position with respect to said receptacle member; and a slide element slidably disposed in said recessed portion, said slide element having a tongue and a rear extension, said tongue extending upwardly from the front end of said slide element and being provided with an inclined outer surface, said inclined outer surface abutting the front end of said cover member when said cover member is in said closed position, said rear extension extending into said recess without contacting said hinge block, and said inclined outer surface, when said rear extension is pushed forwardly, forcing said cover member away from said receptacle member and releasing engagement between said first and second latch means, thereby moving said cover member to an open position.

2. A vanity case as claimed in claim 1, wherein said cover member includes a projection downwardly extending from the lower surface of the front end of said cover nember, said second latch means is formed on said projection, and said inclined outer surface is in contact with the lower end of said projection.

3. A vanity case as claimed in claim 2, wherein said slide element includes a base plate extending longitudinally to integrally connect said tongue with said rear extension, said base plate being slidably fitted in a guide groove formed in the bottom surface defining said recessed portion, said guide groove being communicated with said recess through a cut formed in the rear wall of said receptacle member, and said slide element is prevented from removal by a cosmetic containing tray secured in said recessed portion over said slide element.

4. A vanity case as claimed in claim 1, wherein said slide element includes a cosmetic containing tray, the front wall of said tray forring said tongue, said rear extension extends beyond the rear wall of said tray, and said tray is slidably secured in said recessed portion.

5. A vanity case as claimed in claim 4, wherein said tray is provided on both side walls thereof with lateral protrusions, and the inner side surface of said receptacle member defining said recessed portion is formed with lateral grooves to be engaged with said protrusions, said grooves being longer than said protrusions, thereby permitting slide movement of said tray with said slide element.

* * * * *